US011293133B2

(12) United States Patent
Kim et al.

(10) Patent No.: US 11,293,133 B2
(45) Date of Patent: Apr. 5, 2022

(54) WASHING TUB ARRAY AND WASHING MACHINE INCLUDING THE SAME

(71) Applicant: LG ELECTRONICS INC., Seoul (KR)

(72) Inventors: Daesun Kim, Seoul (KR); Yongkeon Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 26 days.

(21) Appl. No.: 16/935,444

(22) Filed: Jul. 22, 2020

(65) Prior Publication Data

US 2021/0079584 A1 Mar. 18, 2021

(30) Foreign Application Priority Data

Sep. 17, 2019 (KR) ..... 10-2019-0114141

(51) Int. Cl.

| | |
|---|---|
| ***D06F 39/14*** | (2006.01) |
| ***D06F 39/08*** | (2006.01) |
| ***D06F 23/04*** | (2006.01) |
| ***D06F 39/02*** | (2006.01) |

(52) U.S. Cl.

CPC ..... *D06F 39/14* (2013.01); *D06F 23/04* (2013.01); *D06F 39/02* (2013.01); *D06F 39/088* (2013.01)

(58) Field of Classification Search

CPC ..... D06F 39/14; D06F 39/02; D06F 39/088; D06F 23/04

USPC ..... 68/12.18

See application file for complete search history.

(56) References Cited

FOREIGN PATENT DOCUMENTS

| | | |
|---|---|---|
| KR | 10-2006-0082689 | 7/2006 |
| KR | 10-2016-0022861 | 3/2016 |
| KR | 101727910 B1 * | 4/2017 |

OTHER PUBLICATIONS

KR101727910B1—Machine translation (Year: 2017).*

* cited by examiner

*Primary Examiner* — Tinsae B Ayalew

(74) *Attorney, Agent, or Firm* — KED & Associates, LLP

(57) ABSTRACT

A washing tub array may be configured to guide water flow in a washing tub upward. The washing tub may comprise an outer tub, an inner tub, and a tub cover. The tub cover may include a side surface formed to extend in a longitudinal direction along a circumference of the outer tub, the side surface being coupled to the top of the outer tub, a curved surface extending from a top of the side surface to have a curvature and formed to decrease in diameter upward, wherein a water flow guide hole is formed through both sides of the curved surface, and a planar surface formed to extend in a transverse direction from the curved surface so as to cover the circumference of the upper surface of the inner tub.

20 Claims, 7 Drawing Sheets

WASHING TUB ARRAY AND WASHING MACHINE INCLUDING THE SAME

CROSS-REFERENCE TO RELATED APPLICATION(S)

Figure 1:
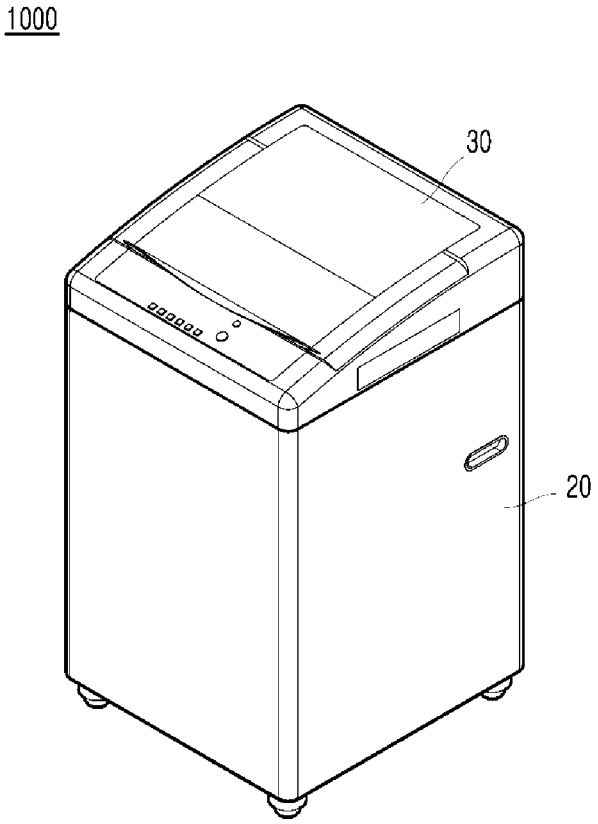

This present application claims benefit of priority to Korean Patent Application No. 10-2019-0114141, filed on Sep. 17, 2019 in the Korean Intellectual Property Office, the entire disclosure of which may be incorporated herein by reference.

BACKGROUND

1. Field

The present disclosure relates to a washing tub array and a washing machine including the same.

2. Background

In general, a washing machine may be a machine that washes laundry by using emulsification via a washing detergent, friction via water flow caused by rotation of washing blades of the washing machine, and impact applied by the washing blades. Such washing machines mainly use power from an electric motor as main power, and remove contaminants from clothing by performing washing, rinsing, and spin-drying processes using detergent, water, rotation, and air.

Washing machines are classified into cylinder type washing machines, agitator type washing machines, and pulsator type washing machines, depending on their washing scheme. While the detailed structure of these types of washing machines may differ in various ways according to their respective functions, each includes, in common, a washing tub in which the laundry may be provided and in which washing, rinsing, and spin-drying processes are performed, and a door configured to open or close a laundry inlet that may be formed in a surface of the washing tub.

Due to structural limitations which cause wash water to flow only within the washing tub and the specificity of its use environment, various parts of the washing machine may be contaminated during long-term use, thereby causing various bacteria harmful to the human body. In this regard, in recent years, as living standards have improved and expectations for quality of life have increased, hygiene and cleanliness of washing machines may be increasingly becoming regarded as important. According to the findings of surveys conducted by relevant research institutes on an internal environment of washing machines, consumers are increasingly interested in and/or concerned about contamination inside washing machines. To fundamentally prevent secondary contamination of laundry in the washing machine and to protect the health of consumers, technology relating to improving the cleanliness of the internal environment of the washing machine is developing.

Korean Patent Application Publication No. 10-2016-0022861 discloses a washing machine that automatically cleans a washing tub. In a washing process in the washing machine, because a rotating blade or an inner drum continuously rotates in forward and reverse directions, water in an outer drum may be exchanged with water in the inner drum to form a water flow, and cleaning pellets in a space between the inner and outer drums move in the water, thus hitting the walls between the inner drum and the outer drum to generate friction. With the help of soakage by the water, the walls of the inner drum and the outer drum and the bottom of the inner drum are cleaned to prevent the generation of contaminants and the breeding of bacteria.

However, such a washing machine merely prevents the generation of contaminants and the breeding of bacteria between the inner drum and the outer drum, but a configuration that prevents the generation of contaminants and the breeding of bacteria by cleaning a portion of the washing tub (in particular, an upper surface of the washing tub) that wash water does not reach may be not disclosed.

Korean Patent Application Publication No. 10-2006-0082689 discloses a washing machine and a method of cleaning a washing tub. The washing tub may be cleaned by supplying water necessary to clean the washing tub to a water tub and rotating the washing tub while applying heat to the water tub by means of at least one heat supply device mounted in the washing machine. However, such a washing machine is a configuration for more effectively cleaning the inside of the washing tub, but not an outer portion of the washing tub (in particular, an upper surface of the washing tub) that wash water does not reach.

As described above, there may be a need for a washing machine that keeps the internal environment of the washing machine clean to prevent the generation of contaminants and the breeding of bacteria. However, in the washing machines of the related art, since portions other than the portion that the wash water reaches are difficult to clean, there are limits in keeping the inside of the washing machine clean.

BRIEF DESCRIPTION OF THE, DRAWINGS

Figure 2:
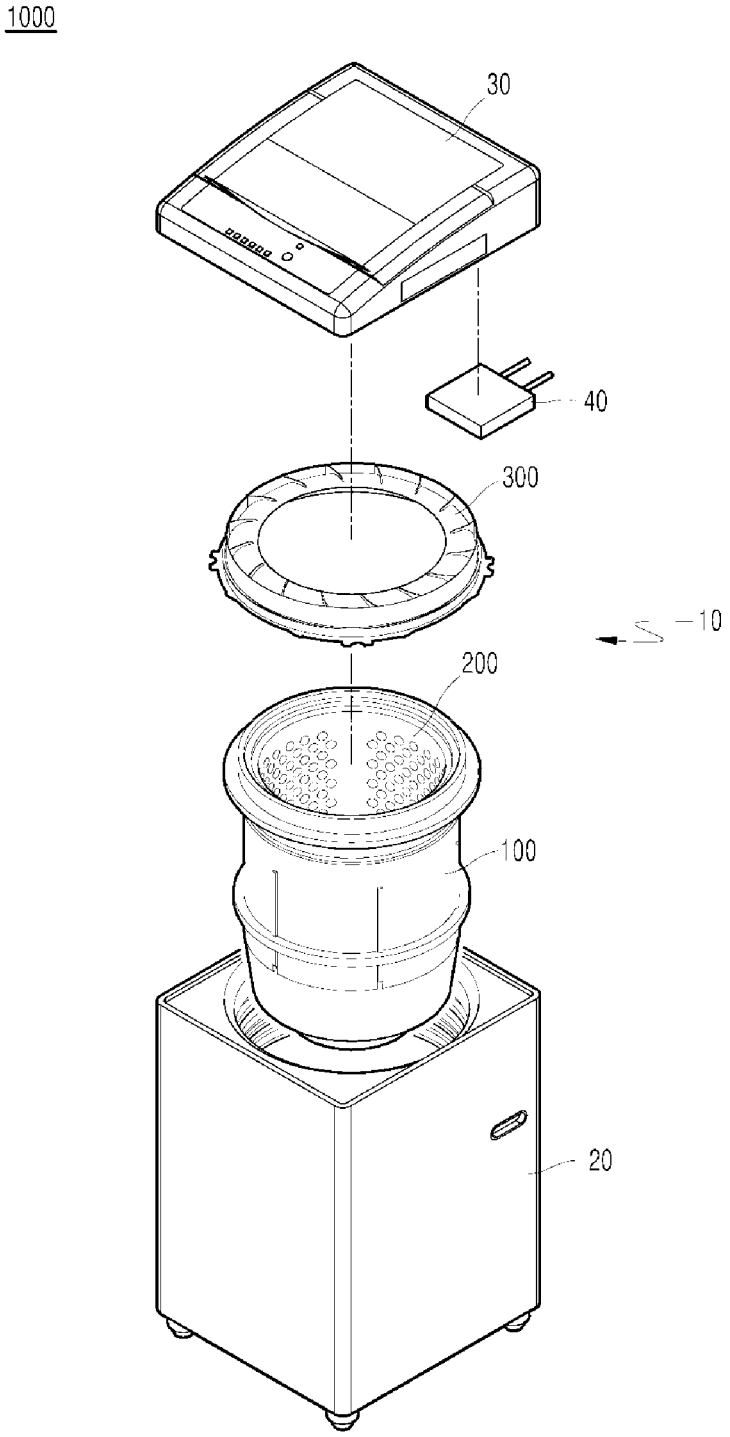
Figure 3:
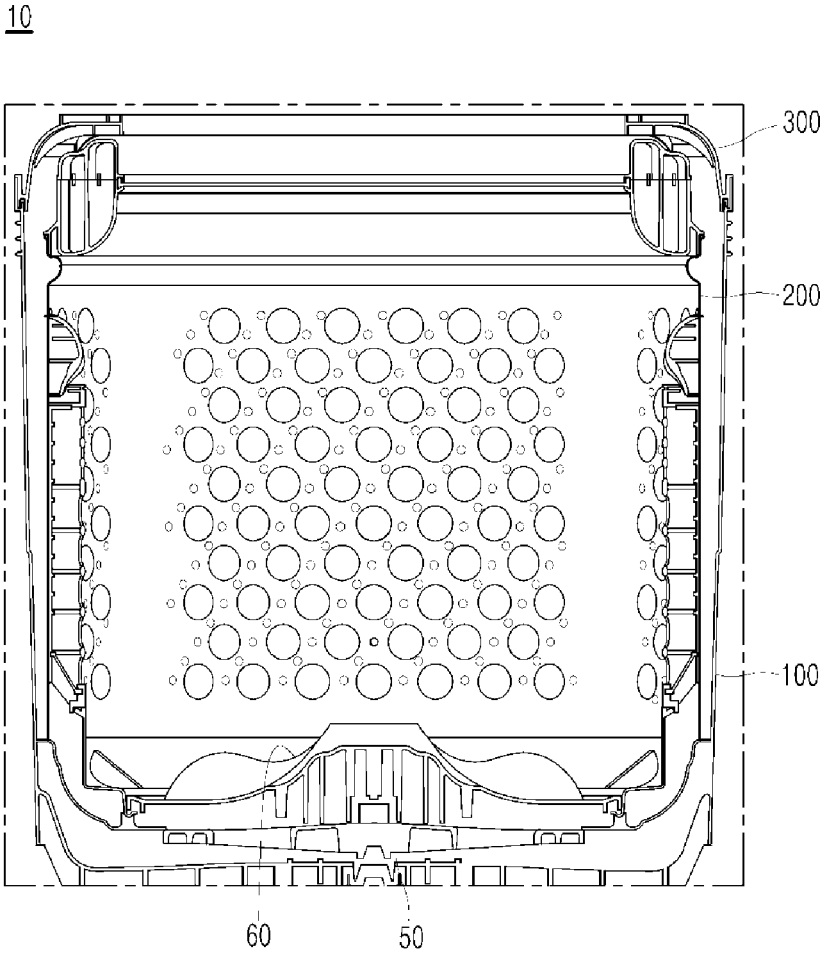
Figure 4:
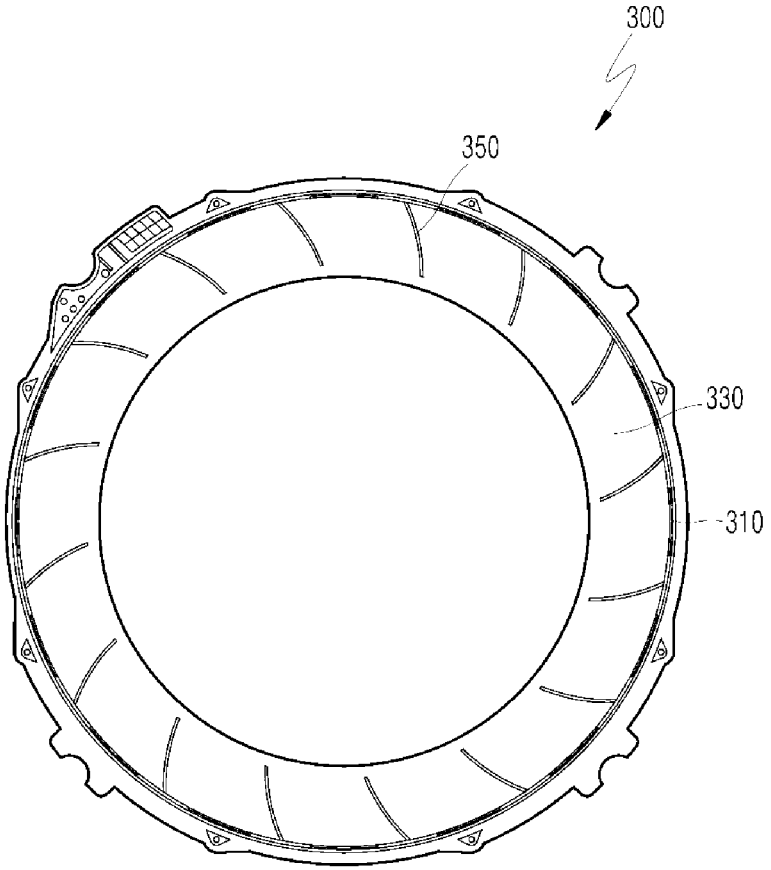
Figure 5:
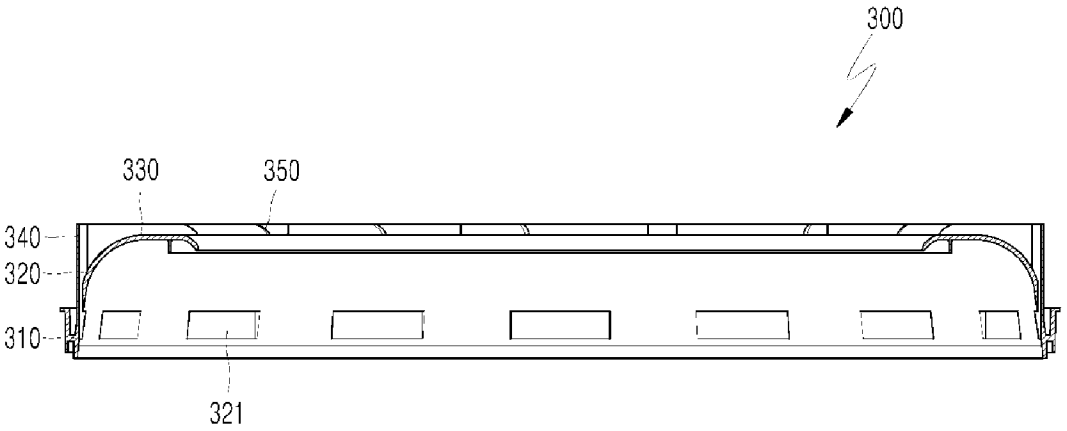
Figure 6:
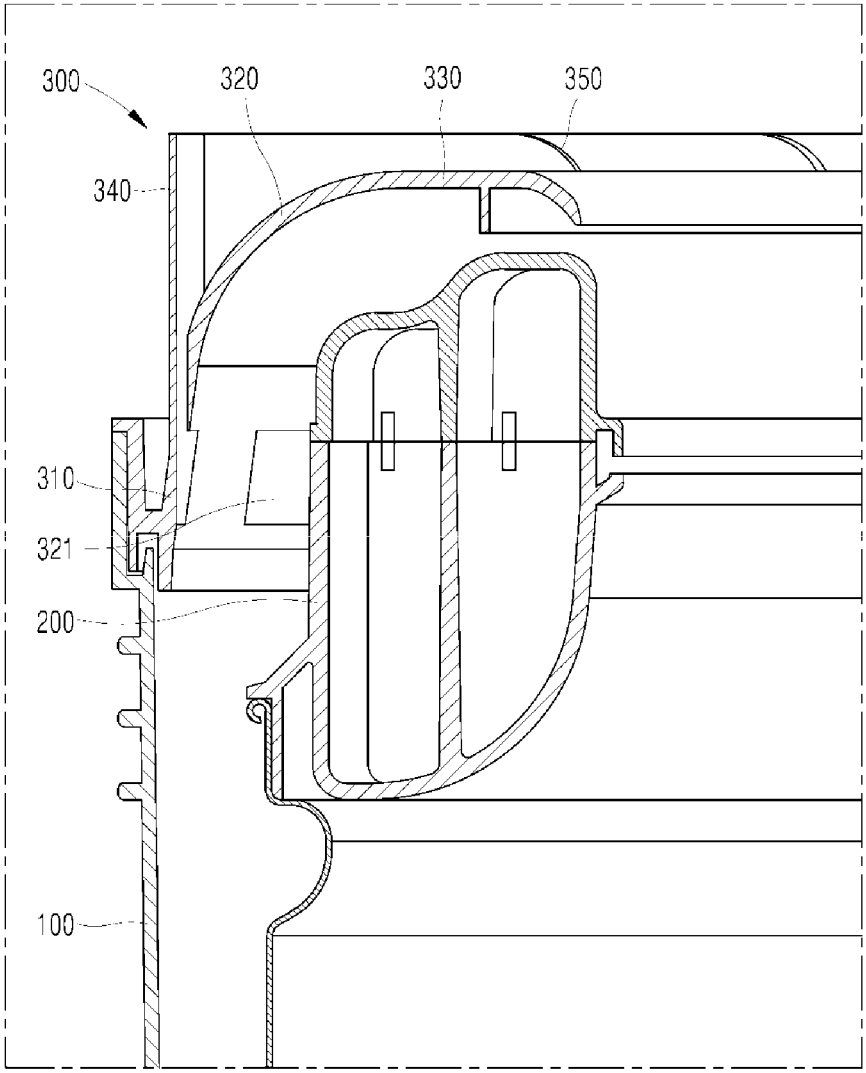
Figure 7:
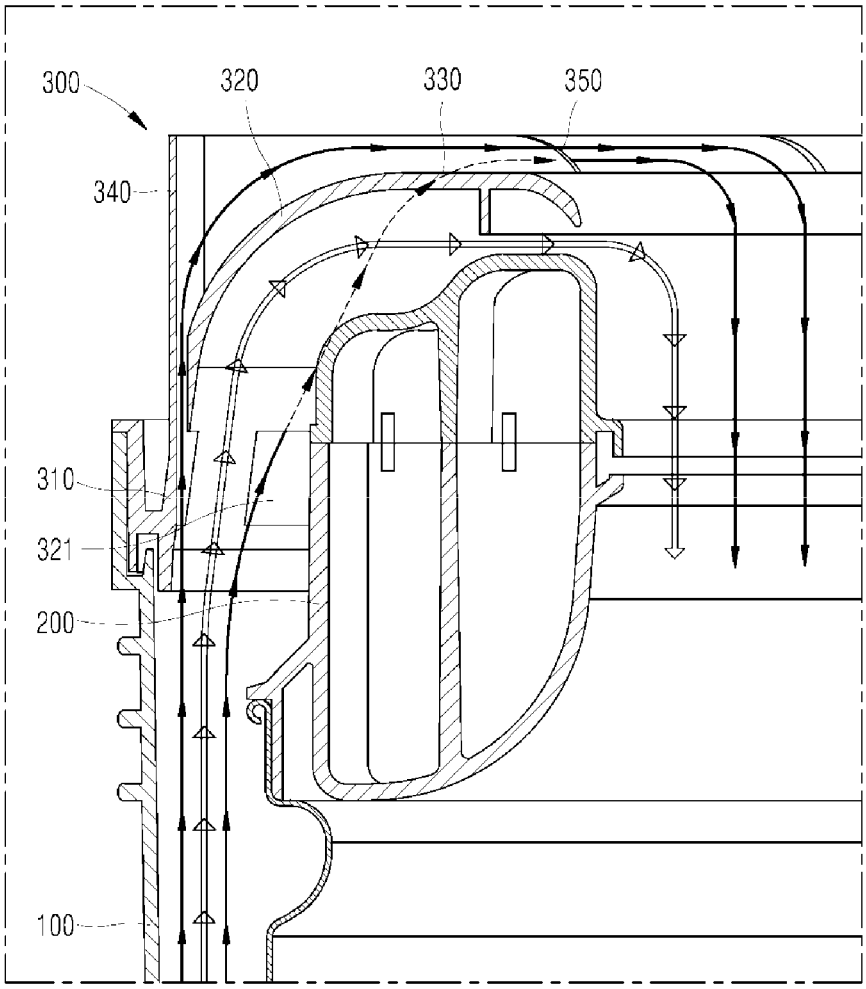

Embodiments will be described in detail with reference to the following drawings in which like reference numerals refer to like elements, and wherein:

FIG. 1 may be a perspective view schematically illustrating a washing machine according to an embodiment;

FIG. 2 may be an exploded perspective view schematically illustrating the washing machine according to an embodiment;

FIG. 3 may be a sectional view illustrating a washing tub array in the washing machine according to an embodiment;

FIG. 4 may be a top view illustrating a tub cover in the washing machine according to an embodiment;

FIG. 5 may be a sectional view illustrating the tub cover in the washing machine according to an embodiment;

FIG. 6 may be a view illustrating in detail an outer tub, an inner tub, and the tub cover in the washing machine according to an embodiment; and FIG. 7 may be a view exemplarily illustrating a state in which wash water may be guided in the outer tub, the inner tub, and the tub cover of FIG. 6.

DETAILED DESCRIPTION

Wherever possible, the same reference numbers will be used throughout the drawings to refer to the same or like parts. In the following description, known functions or structures, which may confuse the substance of the present disclosure, are not explained.

As shown in FIGS. 1 to 3, a washing machine 1000 according to an embodiment may include a cabinet 20, a cabinet cover or door 30, and a washing tub array or assembly 10. The washing machine 1000 may further include a detergent supply device or a detergent suppliers 40.

The cabinet 20 may form a main exterior of the washing machine 1000. The washing tub array 10 may be installed in the cabinet 20, and may receive laundry in the interior thereof through an opening formed in the top of the cabinet 20. The cabinet cover 30 may be coupled to the cabinet 20 to open or close the opening of the cabinet 20, and may be hinged to an upper portion of the cabinet 20 so as to be rotatable about one side thereof.

An input or user interface and/or a display may be installed on the cabinet cover 30. The input interface may include a plurality of control buttons (for example, a power button, an operation button, etc.) and function buttons (for example, washing course, options, etc.), and the display may be configured to display an operating state and progress of the washing machine 1000.

The washing tub array 10 may be installed in the cabinet 20 and may perform processes for laundry accommodated or received therein. The washing tub array 10 may perform at least one of a washing cycle, a rinsing cycle, a drying cycle, or a spin-drying cycle for the accommodated laundry.

The washing tub array 10 may include an outer tub 100 configured to receive supplied wash water or liquid, an inner tub or drum 200 configured to rotate in a clockwise or counterclockwise direction in the outer tub 100, and a tub cover 300 coupled to (e.g., clipped to) a top of the outer tub 100 to cover a circumference of an upper surface of the inner tub 200.

The outer tub 100 may be formed with an accommodation space in which wash water may be provided to perform the processes for the laundry. The inner tub 200 may be installed to be rotatable in the outer tub 100. A plurality of through-holes may be formed in an outer circumferential surface of the inner tub 200, and the wash water may flow into and out of the inner tub 200 through the through-holes. When the wash water is provided in the accommodation space of the outer tub 100, the wash water flows into and out of the inner tub 200 such that the processes for the laundry may be performed.

As shown in FIG. 3, a pulsator 60 for water or liquid flow may be installed on a lower surface of a rotating tub or inner tub 200 of the washing tub array 10. In addition, a motor 50 configured to drive the inner tub 200 and the pulsator 60 and a drain port configured to discharge the wash water that has been contaminated by washing may be installed at the bottom of the outer tub 100 in the cabinet 20. A water supply pipe configured to guide water supplied from an external water source into the washing machine 1000 may be installed at a side of the cabinet 20.

The detergent supply device 40 (FIG. 2) may be installed or provided to supply detergent to the washing tub array 10. The detergent supply device 40 may supply additives such as fabric softener and bleaching agent as well as the detergent to the washing tub array 10 such that various processes for the laundry may be performed.

The washing machine 1000 may perform rinsing of the laundry by repeating the supply of wash water (or supply of wash water and supply of detergent) and the drainage of contaminated wash water. When the rinsing is completed, the washing machine 1000 may drain the contaminated wash water (or the wash water) through the drain port. When the draining is completed, the washing machine 1000 may spin-dry the laundry to remove the wash water remaining in the laundry by rotating the inner tub 200 at a high or predetermined speed.

When the inner tub 200 rotates at a predetermined speed or more while the wash water is accommodated in the outer tub 100, a water flow in which the wash water rises may occur due to centripetal force in a space between an inner wall or surface of the outer tub 100 and an outer wall or surface of the inner tub 200. The inner and outer surfaces of the inner and outer tubs 100 and 200 may also be referred to as inner and outer sides. This rising water flow may be sprayed along the lower surface of the tub cover 300 that covers circumferences of upper surfaces of the outer tub 100 and the inner tub 200, and then flows back into the inner tub 200. A shape or inner contour of the outer tub 100 may correspond to a shape or inner contour of the inner tub 200 so that wash water in the space or gap between the outer and inner tubs 100 and 200 may evenly rise when the inner tub 200 rotates.

Through the above process, a portion of the washing tub array 10 that the wash water reaches may be naturally cleaned. However, in this process, a portion of the washing tub array 10 that the wash water does not reach may not be entirely cleaned. The upper surface of the tub cover 300 may be most frequently seen by a user in the process of putting in and taking out the laundry. As the washing machine may be used for a long time, foreign matter such as dust may accumulate on the upper surface of the tub cover 300, and cleanliness issues may arise if the user does not directly clean the foreign matter.

However, since it may be cumbersome for the user to clean the upper surface of the tub cover 300 every time, the washing machine 1000 according to the present embodiment allows the upper surface of the tub cover 300 to be naturally cleaned while the washing machine may be operating, thereby improving convenience and cleanliness in use.

As shown in FIGS. 4 to 7, the tub cover 300 may include a side surface or section 310, a curved surface or section 320, and a planar surface or section 330, The side surface 310 of the tub cover 300 may be formed to extend in a longitudinal direction along a circumference of the outer tub 100 and may be coupled to the top of the outer tub 100, and may correspond to a portion provided at the bottom of the tub cover 300.

The side surface 310 of the tub cover 300 may be formed of a circular ring-shaped member and have a diameter corresponding to the diameter of an outer circumferential surface of the outer tub 100. As described above, the wash water that rises in the space between the inner wall surface of the outer tub 100 and the outer wall surface of the inner tub 200 may continue to rise along the inner side of the side surface 310 of the tub cover 300, as shown in FIG. 7.

The curved surface 320 of the tub cover 300 may be a portion that extends from the top of the side surface 310 to have a curvature and may be formed to decrease in diameter upward. Also, the curved surface 320 may have a water flow guide hole 321 formed through both sides thereof. The curved surface 320 of the tub cover 300 may be a curved member formed to connect the side surface 310 and the planar surface 330 to each other, and may be formed in a shape similar to an outermost rim of a hemispherical shape.

A traveling direction of the wash water that rises along the inner side of the side surface 310 of the tub cover 300 may be changed so as to be directed in a transverse direction along the inner side of the curved surface 320 of the tub cover 300, as shown in FIG. 7.

Since the water flow guide hole 321 may be formed in the curved surface 320 of the tub cover 300, some of the wash water that rises along the inner side of the side surface 310 of the tub cover 300 may pass through the water flow guide hole 321 and be guided to the upper surface of the tub cover 300, as shown in FIG. 7.

The planar surface 330 of the tub cover 300 may be formed to extend in the transverse direction from the curved surface 320 to cover the circumference of the upper surface of the inner tub 200, and may correspond to a portion located on the top of the tub cover 300. The planar surface 330 of the tub cover 300 may be a disk-shaped member having a central perforation, a width of which may be greater than a size capable of covering the space between the inner surface of the outer tub 100 and the outer surface of the inner tub 200.

The wash water which has changed traveling direction in the transverse direction along the inner side of the curved surface 320 of the tub cover 300 may be sprayed along a lower surface or side of the planar surface 330 of the tub cover 300 and then flow back into the inner tub 200, as shown in FIG. 7.

Further, the wash water guided to the upper surface of the tub cover 300 through the water flow guide hole 321 may flow along the upper surface or side of the planar surface 330 of the tub cover 300 and then flow back into the inner tub 200, as shown in FIG. 7. In this process, the upper side of the planar surface 330 and a portion of the curved surface 320 which corresponds to the upper surface of the tub cover 300 may be naturally cleaned by the wash water.

The side surface 310, the curved surface 320, and the planar surface 330 of the tub cover 300 may be bonded to each other after being shaped as separate members, or alternatively may be formed integrally by shaping one member to correspond to the shapes of the side surface 310, the curved surface 320, and the planar surface 330 of the tub cover 300, respectively. The water flow guide hole 321 may be formed in the curved surface 320 of the tub cover 300, and some of the wash water that rises when the inner tub 200 is rotated may be guided to and flow along the upper surface of the tub cover 300, and then fall into the inner tub 200. As a result, when the washing machine 1000 is operating, the upper surface of the tub cover 300 may be automatically cleaned by the wash water, and convenience and cleanliness in use may thereby be improved.

The tub cover 300 may further include an outer side wall 340 that may be formed to extend to a position higher than the upper surface of the planar surface 330 in a longitudinal direction from the side surface 310. As shown in FIGS. 5 and 6, the outer side wall 340 may be continuous along an outer circumferential surface of the upper surface of the tub cover 300 and formed on the tub cover 300. Further, the height of the outer side wall 340 may be higher than the height of a top surface of the tub cover 300 or the planar surface 330. The outer side wall 340 may alternatively be referred to as a splash guard.

When some of the wash water is guided to the upper surface of the tub cover 300 through the water flow guide hole 321, not only may a lifting force still act on the wash water, but a rotational force exerted to the wash water by rotation of the inner tub 200 may also act on the wash water. There may be a fear that the wash water guided to the upper surface of the tub cover 300 may flow to a portion to which it may be not intended to flow. For example, the wash water may be scattered to the outside due to a rotational force.

Since various electronic components that implement functions of the washing machine 1000 are installed outside the washing tub array 10 in the cabinet 20, it may not be desirable for these components to come into contact with water, as this may cause a short circuit. The outer side wall 340 may be formed on an outer periphery of the upper surface of the tub cover 300 so that the wash water may be guided to flow only toward the inner tub 200 without being scattered to the outside.

The outer side wall 340 may be formed integrally with the tub cover 300 so as to minimize deformation and damage caused by an external force. The outer side wall 340 of the tub cover 300 may be formed to extend to a position higher than the upper surface of the planar surface 330, thereby blocking the wash water from being scattered outside the tub cover 300 and preventing or reducing the wash water from being scattered into portions not intended to come into contact with water and causing functional degradation of the washing machine 1000.

The tub cover 300 may further include a rib 350 that may be formed to protrude upward from the upper surface of the planar surface 330 and the curved surface 320. As shown in FIGS. 4 and 5, the rib 350 may be formed to protrude upward on the upper surface of the tub cover 300. The rib 350 may be formed on the upper surface of the tub cover 300 as well as on the lower surface of the tub cover 300 within a range in which interference with other components may not occur.

As described above, when the water flow guide hole 321 is formed in the tub cover 300, the upper surface of the tub cover 300 may be cleaned automatically by the wash water. However, since a through-hole or the water flow guide hole 321 may be formed in the tub cover 300, the tub cover 300 may be structurally vulnerable. Since a portion where the water flow guide hole 321 may be formed and the portion adjacent thereto may be relatively vulnerable to bending and shearing, these portions may be structurally reinforced.

The rib 350 that protrudes from the upper surface of the tub cover 300 may reinforce a structural rigidity of the tub cover 300 by allowing a cross-sectional area to expand. Even when the water flow guide hole 321 for guiding the wash water may be formed in the tub cover 300, deformation and breakage of the portion of the tub cover 300 reinforced by the rib 350 may be minimized.

The rib 350 may be formed such that one end thereof may be coupled to the outer side wall 340 and the other end thereof extends toward an inner circumferential surface of the planar surface 330 from the one end. The rib 350 may be formed along the width of the upper surface of the tub cover 300.

As shown in FIG. 4, when the upper surface of the tub cover 300 is formed in a circular shape having a constant width, a circumferential direction corresponds to a major axis, and a width direction corresponds to a minor axis. Since the circumferential direction corresponding to the major axis may be more vulnerable to, for example, bending and shearing, the rib 350 may be formed along the width direction corresponding to the minor axis to reinforce the structure in the major axis direction. The rib 350 of the tub cover 300 may be formed to extend over the inner circumferential surface of the planar surface 330 from the outer side wall 340. The rib 350 formed along the minor axis direction of the planar surface 330 may reinforce the structural rigidity in the major axis direction, which may be relatively vulnerable.

Furthermore, the rib 350 may be formed to extend in a spiral or curved trajectory from the outer side wall 340 toward the inner circumferential surface of the planar surface 330. As shown in FIG. 4, the shape in which the rib 350 extends may not be a straight line toward the center of the tub cover 300, but may be an oblique spiral.

When some of the wash water is guided to the upper surface of the tub cover 300 through the water flow guide hole 321, the rotational force exerted on the wash water by rotation of the inner tub 200 may act, to some extent, on the wash water. The wash water guided to the upper surface of the tub cover 300 may tend to flow, to some extent, along a spiral direction. By forming the rib 350 in a spiral to correspond to the flow direction of the wash water, the wash water may flow more smoothly on the upper surface of the tub cover 300.

The spiral direction of the rib 350 may be appropriately selected from a clockwise or counterclockwise direction, considering the main rotational direction of the inner tub 200. The wash water guided to the upper surface of the tub cover 300 may flow more smoothly in the direction corresponding to the rotation of the inner tub 200.

A plurality of water flow guide holes 321 and a plurality of ribs 350 may be formed, respectively, and the ribs 350 may be formed between water flow guide holes 321 that are adjacent to each other.

As an alternative, for the wash water guided to the upper surface of the tub cover 300 to flow most smoothly, the ribs 350 may be omitted, and no protrusions may exist on the upper surface of the tub cover 300. However, as described above, the rib 350 may be formed on the upper surface of the tub cover 300 to structurally reinforce the tub cover 300 at a vicinity of the water flow guide hole 321, which may be a structurally vulnerable portion.

The flow of wash water may be affected by some extent by the rib 350. Considering both the flow of wash water and the structural reinforcement, the rib 350 may be formed between water flow guide holes 321 that are adjacent to each other. As a result, the structural reinforcement may be achieved smoothly while minimizing the influence on the flow of wash water. The vicinity of the water flow guide hole 321, which may be a most vulnerable portion, may be reinforced, without blocking the flow of wash water guided to the upper surface of the tub cover 300.

The water flow guide holes 321 may be arranged at equal intervals in the curved surface 320. As shown in FIG. 5, the water flow guide holes 321 may respectively be formed at positions that partition the curved surface 320 into regular intervals.

Since a portion of the tub 300 near the water flow guide holes 321 may be structurally vulnerable, the water flow guide holes 321 may be separated from each other as much as possible and/or a number of water flow guide holes 321 may be reduced, while still maintaining a sufficient number of water flow guide holes 321 to guide the wash water to the upper surface of the tub cover 300. The water flow guide holes 321 may be evenly distributed so that the upper surface of the tub cover 300 may be cleaned evenly throughout, and also, structural vulnerability of a specific portion of the tub cover 300 may be prevented. There may be sixteen (16) water flow guide holes 321 arranged at equal intervals along the circumference of the tub cover 300, but embodiments disclosed herein are not limited.

The planar surface 330 of the tub cover 300 may be formed such that a height of an end or inner portion of the inner circumferential surface thereof may be lower than a height of the remaining portion of the inner circumferential surface thereof. As shown in FIGS. 5 to 7, the inner or end portion of the planar surface 330 of the tub cover 300 may be formed to be inclined downward toward the inner tub 200, while the remaining portion or outer portion of the inner circumferential surface thereof may be formed to be flat.

The wash water guided to the upper surface of the tub cover 300 may flow back into the inner tub 200 after cleaning the upper surface of the tub cover 300. A structure, such as the inclined end portion of the planar portion 330, may be required to allow the wash water guided to the upper surface of the tub cover 300 to flow smoothly toward the inner tub 200. It may be desirable to allow the wash water to flow more smoothly toward the inner tub 200 via gravity by forming the planar surface 330 of the tub cover 300 such that the height of the end portion of the inner circumferential surface thereof may be lower than the height of the remaining portion of the inner circumferential surface thereof.

The water flow guide hole 321 may be formed to be opened or closed in whole or in part. If necessary, the wash water may not be guided and/or blocked to the upper surface of the tub cover 300, or an amount of wash water to be guided may be adjusted.

When the washing machine 1000 is used, cleaning of the upper surface of the tub cover 300 may be required. However, it may not be necessary to clean the upper surface of the tub cover 300 every time the washing machine 1000 is used. For example, the upper surface of the tub cover 300 may be set to be cleaned once every three times the washing machine 1000 is operated, and a predetermined cleanliness of the washing machine 1000 may be maintained.

When some of the wash water is guided to the upper surface of the tub cover 300, an amount of wash water sprayed into the inner tub 200 along the lower surface of the tub cover 300 may be reduced by the amount of the wash water guided to the upper surface of the tub cover 300. As a result, a washing effect for the laundry may be relatively deteriorated. The user may want to have the upper surface of the tub cover 300 automatically cleaned only when the user desires. Accordingly, it may be necessary to close the water flow guide hole 321. Alternatively, when relatively simple cleaning of the upper surface of the tub cover 300 may be required, the washing machine 1000 may be used after setting the open area of the water flow guide hole 321 to be relatively small.

By allowing the user to adjust whether the water flow guide hole 321 may be opened or closed and a degree of opening or closing of the water flow guide hole 321 depending on the needs of the user, the original function of the washing machine 1000 may be further improved. The water flow guide hole 321 of the tub cover 300 may be formed to be opened or closed in whole or in part as necessary. As a result, when cleaning of the upper surface of the tub cover 300 is not required, the wash water may be concentrated only in washing, thereby further improving the washing effect. For example, a size of the water flow guide hole 321 may be adjusted via an attachable cover, lid, door, sliding or hinged cover, a shutter mechanism, or another structure, and/or the size of the water flow guide hole 321 may be predetermined based on needs of a user.

Detergent may be supplied to the washing tub array 10 from the detergent supply device 40 after water flow may be guided to the upper surface of the tub cover 300 by rotation of the inner tub 200. When washing of the laundry and cleaning of the upper surface of the tub cover 300 are performed at the same time, contaminated wash water generated in the process of cleaning the upper surface of the tub cover 300 may flow back into the inner tub 200 and be used to wash the laundry.

The laundry, which may be relatively sensitive to contamination, may be additionally contaminated by the contaminated wash water from the upper surface of the tub cover 300. In some cases, washing for the laundry may not be sufficiently performed. It may be desirable to preemptively clean the upper surface of the tub cover 300 before the washing process of the laundry, so that in a subsequent step, the laundry may not be additionally contaminated even when the upper surface of the tub cover 300 is cleaned at the same time as the laundry is washed.

The detergent may be supplied to the washing tub array 10 after the wash water may be guided to the upper surface of the tub cover 300. As a result, the upper surface of the tub cover 300 may be preemptively cleaned before starting the main process of washing.

The water flow guide hole 321 may be closed after the detergent is supplied to the washing tub array 10 from the detergent supply device 40. After the washing process for the laundry is started, control may be performed such that no cleaning is performed on the upper surface of the tub cover 300.

When cleaning of the upper surface of the tub cover 300 is performed simultaneously with washing of the laundry, the laundry may be additionally contaminated. Therefore, it may be desirable to close the water flow guide hole 321 when starting the washing process after performing preemptive cleaning of the upper surface of the tub cover 300.

The water flow guide hole 321 may be closed after the detergent is supplied to the washing tub array 10. Additional contamination of the laundry caused by cleaning of the upper surface of the tub cover 300 during the washing process may be prevented.

The present disclosure may be directed to solving the above mentioned issues associated with a washing tub array and a washing machine including the same in some related art described above. Embodiments disclosed herein may improve convenience and cleanliness in use by automatically cleaning an upper surface of a tub cover with wash water when a washing machine may be operating. Embodiments disclosed herein may prevent or reduce functional degradation of the washing machine that may result from portions not intended to come into contact with water coming into contact with water by preventing or reducing the wash water from being scattered to the outside while the upper surface of the tub cover may be cleaned by the wash water.

Embodiments disclosed herein may secure structural rigidity by which deformation and breakage of a corresponding portion may be minimized, even when a structure of the washing machine may be designed to guide the wash water to the upper surface of the tub cover. Embodiments disclosed herein re not limited to what has been described above, and other aspects not mentioned herein will be apparent from the description to one of ordinary skill in the art to which the present disclosure pertains.

Embodiments disclosed herein may be implemented as a washing tub array and a washing machine including the same configured such that when an inner tub is rotated, wash water may be guided to an upper surface of a tub cover to clean the upper surface. A water flow guide hole may be formed in a curved surface of the tub cover, and some of the wash water that rises when the inner tub is rotated may be guided to and flow along the upper surface of the tub cover, and then fall into the inner tub.

Embodiments disclosed herein may be implemented as a washing tub array and a washing machine including the same configured to prevent the wash water guided to the upper surface of the tub cover from being scattered outside of the tub cover when the inner tub may be rotated. Specifically, an outer side wall of the tub cover may be formed to extend to a position higher than an upper surface of a planar surface of the tub cover so as to block the wash water from scattering outside of the tub cover.

Embodiments disclosed herein may be implemented as a washing tub array and a washing machine including the same configured to maintain structural rigidity of the tub cover even when the water flow guide hole may be formed in the tub cover. Specifically, a rib may be formed to protrude upward from the upper surface of the tub cover to reinforce the structural rigidity of the tub cover. The rib of the tub cover may be formed to extend over an inner circumferential surface of the planar surface from the outer side wall. The rib of the tub cover may be formed to extend in a spiral. The rib of the tub cover may be formed between water flow guide holes that are adjacent to each other, among a plurality of water flow guide holes. The plurality of water flow guide holes may be arranged at equal intervals from each other.

The planar surface of the tub cover may be formed to be inclined toward the inside of the inner tub. The water flow guide holes of the tub cover may be formed to be opened or closed in whole or in part as necessary. Detergent may be supplied to the washing tub array after the wash water is guided to the upper surface of the tub cover. The water flow guide hole may be closed after the detergent may be supplied to the washing tub array.

Aspects which may be achieved by the present disclosure are not limited what has been disclosed hereinabove, and other aspects can be clearly understood from the description by those skilled in the art to which the present disclosure pertains.

Embodiments disclosed herein may provide a water flow guide hole formed in a curved surface of a tub cover, and accordingly, some of the wash water that rises when an inner tub is rotated may be guided to and flow along an upper surface of the tub cover, and then fall into the inner tub. As a result, when the washing machine is operating, an upper surface of the tub cover may be automatically cleaned by the wash water so that convenience and cleanliness in use may be improved.

An outer side wall of the tub cover may be formed to extend to a position higher than an upper surface of the planar surface of the tub cover, thereby blocking the wash water from being scattered outside the tub cover. As a result, it may be possible to prevent the wash water from being scattered into portions or devices not intended to come into contact with water and causing functional degradation of the washing machine.

A rib may be formed to protrude upward from the upper surface of the tub cover, thereby reinforcing a structural rigidity of the tub cover. As a result, even when the water flow guide hole for guiding the wash water may be formed in the tub cover, deformation and breakage of a corresponding portion may be minimized.

The rib of the tub cover may be formed to extend over the inner circumferential surface of the planar surface from an outer side wall. As a result, the rib formed along a minor axis direction of the planar surface may reinforce the relatively vulnerable rigidity in a major axis direction.

The rib of the tub cover may be formed to extend in a spiral. The wash water guided to the upper surface of the tub cover may flow more smoothly in a direction corresponding to rotation of the inner tub.

The rib of the tub cover may be formed between water flow guide holes that are adjacent to each other, among a plurality of water flow guide holes. As a result, the vicinity of the water flow guide hole, which may be the most vulnerable portion, may be reinforced without blocking the flow of the wash water guided to the upper surface of the tub cover.

The plurality of water flow guide holes may be arranged at equal intervals from each other, and thus, it may be possible not only to be able to clean the entire upper surface of the tub cover evenly, but also to prevent a specific portion from being structurally vulnerable.

The planar surface of the tub cover may be formed to be inclined toward the inside of the inner tub. As a result, the wash water guided to the upper surface of the tub cover may fall more smoothly into the inner tub.

The water flow guide hole of the tub cover may be formed to be opened or closed in whole or in part as necessary. As a result, when cleaning of the upper surface of the tub cover may not be required, the wash water may be concentrated only for washing, so that washing effect may be improved.

The detergent may be supplied to the washing tub array after the wash water may be guided to the upper surface of the tub cover. The upper surface of the tub cover may be preemptively cleaned before starting a main process of washing.

The water flow guide hole may be closed after the detergent is supplied to the washing tub array. As a result, additional contamination of the laundry caused by cleaning of the upper surface of the tub cover during the washing process may be prevented.

Embodiments disclosed herein may be implemented as a washing tub assembly or array comprising an outer tub having a first opening of a first diameter, an inner tub rotatably provided in the outer tub and having a second opening of a second diameter, the first diameter being greater than the second diameter such that a gap exists between the outer and inner tubs, and a cover coupled to the outer tub and having a third opening of a third diameter such that the cover covers the gap, the cover including a plurality of holes over the gap. The inner tub may be configured to rotate at a predetermined speed or more to induce a wash water to overflow through the gap to the cover through the plurality of holes. The cover may be configured to guide liquid flowing through the holes into the second opening.

The cover may includes a first section coupled to the tub so as to extend above the tub, a second section that may be coupled to the first section and at least partially provided a position that may be radially between the outer diameter and the first inner diameter, the plurality of holes being formed in the second section, a third section extending from the second section to cover an upper surface of the drum at a position that may be radially between the gap and second diameter, and a fourth section coupled to the first section and extending above the first, second, and third sections.

The cover may include at least one rib formed to protrude from an upper surface of the cover and configured to guide the wash water into the third opening. The rib may extend from an outer diameter of the cover toward an inner diameter of the cover. The rib may be curved with respect to a radial axis of the cover, the radial axis connecting the outer and inner diameters.

The at least one rib may include a plurality of ribs, and the ribs may be provided at positions that are circumferentially between positions of adjacent holes. The holes may be arranged at equal intervals along a circumference of the cover.

An inner circumferential surface of the cover defining the third opening may be inclined downward to guide the wash water into the third opening. The holes may be formed to be selectively opened, partially opened, or closed.

Embodiments disclosed herein may be implemented as a washing machine comprising a cabinet having an inlet, a cabinet cover coupled to the cabinet, an outer tub provided in the inlet, an inner tub rotatably provided in the outer tub and having an inner space, and a tub cover coupled to the outer tub and including a plurality of openings provided at positions that are radially between the outer tub and the inner tub. The inner tub may be configured to rotate at a predetermined speed or more to induce liquid provided between the inner and outer tubs to overflow through the openings. A shape of the cover may be configured to guide liquid that has flowed through the openings into the inner space of the inner tub.

The tub cover may include a first section coupled to the outer tub and formed to extend in a longitudinal direction of the outer tub, a second section provided above an upper surface of the inner tub and formed to extend in a transverse direction of the inner tub, and a third section connecting the first and second sections, the third section being curved and having the plurality of openings. The cover may include a fourth section formed to extend in the longitudinal direction of the outer tub above the second and third sections to prevent liquid flowing over the second and/or third sections from being sprayed outward past the outer tub.

An outer surface of the tub cover may include at least one rib configured to guide liquid flowing through the openings into the inner space. Liquid may be supplied to an inside of the outer tub, and the inner tub may include a plurality of through holes through which liquid flows to the inner space. A detergent supply device may be configured to supply detergent to the liquid. The detergent may be supplied after liquid has flowed to the openings. The openings may be closed after the detergent may be supplied.

Embodiments disclosed herein may be implemented as a washing machine comprising a tub configured to receive liquid, a drum rotatably provided inside of the tub, an outer surface of the drum being spaced apart from an inner surface of the tub to define a gap, and a cover coupled to the tub to be provided over the gap and a rim of the drum. The cover may include at least one opening communicating with the gap such that, when the drum may be rotated at a predetermined speed or more, liquid in the gap raises to the opening to overflow over at least one of an outer surface of the cover or the rim of the drum.

The cover may include an incline extending from an inner end toward a center of the drum such that liquid flowing over the outer surface of the cover may be guided to an inside of the drum via the incline, a rib formed on the outer surface of the cover to guide liquid flowing over the outer surface of the cover toward the incline, and a splash guard provided at an outer end of the cover to block liquid flowing over the outer surface of the cover from being sprayed outward to an outer side of the tub. A portion of the cover provided over the gap may be curved so as to guide liquid flowing through the opening to an upper surface of the cover.

Further scope of applicability of the present disclosure will be apparent from the above detailed description. It should be understood, however, that specific examples, such as the detailed description and the preferred embodiments of the present disclosure, are given by way of illustration only, since various changes and modifications within the spirit and scope of the present disclosure will become apparent to those skilled in the art.

While the foregoing has been given by way of illustrative example of the present disclosure, all such and other modifications and variations thereto as would be apparent to those skilled in the art are deemed to fall within the broad scope and ambit of this disclosure as is herein set forth. Accordingly, such modifications or variations are not to be regarded as a departure from the spirit or scope of the present disclosure, and it is intended that the present disclosure cover the modifications and variations of this invention provided they come within the scope of the appended claims and their equivalents.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A washing tub assembly, comprising:

an outer tub having a first opening of a first diameter;

an inner tub rotatably provided in the outer tub and having a second opening of a second diameter, the first diameter being greater than the second diameter such that a gap exists between the outer and inner tubs; and a cover coupled to the outer tub and having a third opening of a third diameter such that the cover covers the gap, the cover including a plurality of holes over the gap, wherein the inner tub is configured to rotate at a predetermined speed or more to induce a wash water to overflow through the gap to the cover through the plurality of holes, and the cover is configured to guide liquid flowing through the holes into the second opening, and wherein the cover includes:

a first section coupled to the outer tub so as to extend above the outer tub, a second section that is coupled to the first section and at least partially provided at a position that is radially between the first diameter and the second diameter, the plurality of holes being formed in the second section, and a third section extending from the second section to cover an upper surface of the drum at a position that is radially between the gap and second diameter.

2. The washing tub assembly of claim 1, wherein the cover includes:

a fourth section coupled to the first section and extending above the first, second, and third sections.

3. The washing tub assembly of claim 1, wherein the cover includes at least one rib formed to protrude from an upper surface of the cover and configured to guide the wash water into the third opening.

4. The washing tub assembly of claim 3, wherein the rib extends from an outer diameter of the cover toward an inner diameter of the cover.

5. The washing tub assembly of claim 4, wherein the rib is curved with respect to a radial axis of the cover, the radial axis connecting the outer and inner diameters.

6. The washing tub assembly of claim 4, wherein the at least one rib includes a plurality of ribs, and the ribs are provided at positions that are circumferentially between positions of adjacent holes.

7. The washing tub assembly of claim 6, wherein the holes are arranged at equal intervals along a circumference of the cover.

8. The washing tub assembly of claim 1, wherein an inner circumferential surface of the cover defining the third opening is inclined downward to guide the wash water into the third opening.

9. The washing tub assembly of claim 1, wherein the holes are formed to be selectively opened, partially opened, or closed.

10. A washing machine, comprising:

a cabinet having an inlet;

a cabinet cover coupled to the cabinet;

an outer tub provided in the inlet;

an inner tub rotatably provided in the outer tub and having an inner space; and a tub cover coupled to the outer tub and including a plurality of openings provided at positions that are radially between the outer tub and the inner tub, wherein the inner tub is configured to rotate at a predetermined speed or more to induce liquid provided between the inner and outer tubs to overflow through the openings, and a shape of the tub cover is configured to guide liquid that has flowed through the openings into the inner space of the inner tub, and wherein the tub cover includes:

a first section coupled to the outer tub and formed to extend in a longitudinal direction of the outer tub;

a second section provided above an upper surface of the inner tub and formed to extend in a transverse direction of the inner tub; and a third section connecting the first and second sections, the third section being curved and having the plurality of openings.

11. The washing machine of claim 10, wherein the tub cover includes a fourth section formed to extend in the longitudinal direction of the outer tub above the second and third sections to prevent liquid flowing over the third section from being sprayed outward past the outer tub.

12. The washing machine of claim 10, wherein an outer surface of the tub cover includes at least one rib configured to guide liquid flowing through the openings into the inner space.

13. The washing machine of claim 10, wherein liquid is supplied to an inside of the outer tub, and the inner tub includes a plurality of through holes through which liquid flows to the inner space.

14. The washing machine of claim 10, further comprising a detergent supply device configured to supply detergent to the liquid.

15. The washing machine of claim 14, wherein the detergent is supplied after liquid has flowed to the openings.

16. The washing machine of claim 14, wherein the openings are closed after the detergent is supplied.

17. A washing machine, comprising:

a tub configured to receive liquid;

a drum rotatably provided inside of the tub, an outer surface of the drum being spaced apart from an inner surface of the tub to define a gap; and a cover coupled to the tub to be provided over the gap and a rim of the drum, the cover including at least one opening communicating with the gap such that, when the drum is rotated at a predetermined speed or more, liquid in the gap raises to the opening to overflow over at least one of an outer surface of the cover or the rim of the drum, wherein the cover includes:

a first section coupled to the tub and formed to extend in a longitudinal direction of the tub;

a second section provided above an upper surface of the drum and formed to extend in a transverse direction of the drum; and a third section connecting the first and second sections, the third section being curved and having the opening.

18. The washing machine of claim 17, wherein the cover includes:

an incline extending from an inner end toward a center of the drum such that liquid flowing over the outer surface of the cover is guided to an inside of the drum via the incline;

a rib formed on the outer surface of the cover to guide liquid flowing over the outer surface of the cover toward the incline; and a splash guard provided at an outer end of the cover to block liquid flowing over the outer surface of the cover from being sprayed outward to an outer side of the tub.

19. The washing machine of claim 18, wherein a portion of the cover provided over the gap is curved so as to guide liquid flowing through the opening to an upper surface of the cover.

20. The washing machine of claim 17, wherein the cover includes a fourth section coupled to the first section and extending above the first, second, and third sections.

* * * * *